US005907874A

United States Patent [19]

Guyton

[11] Patent Number: 5,907,874

[45] **Date of Patent: *Jun. 1, 1999**

[54] FLUSHABLE PORTABLE TOILET

[75] Inventor: Dean L. Guyton, Glassboro, N.J.

[73] Assignee: Dgic, llc, Glassboro, N.J.

[ * ] Notice: This patent is subject to a terminal disclaimer.

[21] Appl. No.: 08/876,924

[22] Filed: Jun. 16, 1997

Related U.S. Application Data

[63] Continuation of application No. 08/499,616, Jun. 7, 1995, Pat. No. 5,638,555, which is a continuation-in-part of application No. PCT/US94/03350, Mar. 29, 1994, which is a continuation-in-part of application No. 08/038,924, Mar. 29, 1993, abandoned.

[51] Int. Cl.[6] ..... A61G 9/02

[52] U.S. Cl. ..... 4/457; 4/233; 4/300.2; 4/340

[58] Field of Search ..... 4/443–448, 420.3, 4/665, 666, 340, 341, 342, 471–473, 479, 483, 457, 300.2, 307, 312, 429

[56] References Cited

U.S. PATENT DOCUMENTS

| | | | |
|---|---|---|---|
| 921,962 | 5/1909 | Don Jian | 4/445 |
| 1,597,129 | 8/1926 | Watters . | |
| 1,630,932 | 5/1927 | Friedrich . | |
| 1,711,295 | 4/1929 | Wernle . | |
| 2,075,830 | 4/1937 | Salvoni | 4/445 |
| 2,527,270 | 10/1950 | Levin . | |
| 2,611,134 | 9/1952 | Jarrett et al. . | |
| 2,834,026 | 5/1958 | Kronish . | |
| 2,882,708 | 4/1959 | Hancock et al. | 4/666 |
| 2,986,745 | 6/1961 | Melzassard . | |
| 3,083,375 | 4/1963 | Jewell . | |
| 3,166,767 | 1/1965 | Jewell et al. . | |
| 3,327,323 | 6/1967 | Miller, Jr. . | |
| 3,570,271 | 3/1971 | Brown | 4/666 |
| 3,742,522 | 7/1973 | Stevenson . | |
| 4,366,584 | 1/1983 | Mchuma . | |
| 4,552,515 | 11/1985 | Endo . | |
| 4,759,085 | 7/1988 | Ottosson . | |
| 4,769,860 | 9/1988 | Sargent et al. . | |
| 4,797,959 | 1/1989 | Decaux . | |
| 4,995,410 | 2/1991 | Lash | 4/665 |
| 5,067,186 | 11/1991 | Ayers | 4/445 |
| 5,083,325 | 1/1992 | Vitullo . | |
| 5,090,067 | 2/1992 | Cogdill | 4/448 |

FOREIGN PATENT DOCUMENTS

| | | | |
|---|---|---|---|
| 2741562 | 3/1979 | Germany . | |
| 988 | of 1874 | United Kingdom | 4/473 |
| 608448 | 9/1948 | United Kingdom . | |

*Primary Examiner*—Charles R. Eloshway
*Attorney, Agent, or Firm*—Dann, Dorfman, Herrell and Skillman, P.C.; Henry H. Skillman

[57] ABSTRACT

An apparatus for disposing of body waste in a portable toilet is comprised of a container (100) and an associated hollow housing structure (14) which are adapted to be seated on a conventional toilet (B). Waste in container (100) is dumped into the toilet via a cable mechanism (154) on the intake stroke of a hand pump (170). A water intake hose (172) is manually lowered into the toilet water via a hose control handle (162) prior to the operation of the pump. While the container (100) is in a vertical dumping position, the exhaust stroke of pump (170) forces water siphoned from the toilet through a jet outlet (180) to clean the interior of the container (100). The waste and toilet water in the container (100) is discharged directly into the bowl without impinging the hollow housing structure. The container (100) automatically returns to its rest, or horizontal, position due to the action of a return spring.

12 Claims, 4 Drawing Sheets

FLUSHABLE PORTABLE TOILET

RELATED APPLICATION

The present application is a continuation of application Ser. No. 08/499,616, filed Jun. 7, 1995, a now U.S. Pat. No. 5,638,555, which was a continuation-in-part of PCT/US94/03350, filed Mar. 29, 1994, which was a continuation-in-part of application Ser. No. 08/038,924, filed Mar. 29, 1993, and now abandoned.

FIELD OF THE INVENTION

The present invention relates to portable commodes having a removable waste container. More specifically, the invention relates to products such as a child's potty, medical commodes and bed pans which use waste containers to receive body waste. The removable container has a portable support which may be moved to afford dumping of the contents of the container into residential or institutional fixed commodes and rinsed with fresh water until clean. After cleaning, the container is returned to its operative position and fresh water may be deposited into the container to limit sticking of body waste to the container when reused.

BACKGROUND OF THE INVENTION

Known prior art devices include portable supports having removable waste containers. The portable supports are designed to accommodate infants or toddlers or medical patients who cannot use conventional fixed commodes because of their immaturity or their physical limitations. The prior portable commodes vary in size and design. For example, U.S. Pat. No. 5,083,325 discloses a portable commode in the form of a simulation of an automobile. The Lumex Company of Bayshore, N.Y., markets a portable commode in the form of a chair having a cushion which comes off to access the commode. In practically all cases, the body waste container is independent of the seat portion of the support and either slides into position under the seat or is dropped into position under the seat on the support structure. With prior art portable commodes, water is usually deposited in the bottom of the waste container prior to use, and this water along with the waste is dumped into a fixed commode. The emptied container is then rinsed at a separate facility, such as an institutional or commercial sink, or a tub or shower, or similar source of fresh water. Depending upon the nature of the waste, the rinsing and dumping process is sometimes repeated frequently for cleaning satisfaction. In transferring the waste container from the commode for dumping to the water supply for rinsing, spillage may occur leading to unsanitary conditions.

Repeated rinsing of the waste container is wasteful of resources, and the present invention is designed to eliminate the necessity for repeated rinsing and dumping and transferring of the waste container from the water source to the fixed commode.

SUMMARY OF THE INVENTION

A primary object of the present invention is to provide an improved portable commode having a removable and reusable body waste container which may be cleaned by setting the portable commode on top of the waste-receiving bowl of a flush toilet and using fresh toilet water from the flushed toilet to rinse the waste container. The rinse water is dumped into the bowl.

The illustrated embodiment of the present invention provides a support for the waste container which rinses it and dumps it while positioned on top of the fixed commode. The container has a horizontal rest position which renders the container in an operative waste-receiving condition and an inverted position which renders the container in a dumping condition.

Specifically, the present invention enables the use of fresh water from the fixed commode to rinse the container as it is dumped into the bowl.

In an illustrated embodiment, the use of water from the fixed commode permits the discharge of the waste material from the waste container with a single flushing of the fixed commode after the waste container is dumped by operating the container from its operative condition to its dumping condition.

The present invention provides a flushing nozzle for the waste container which eliminates the need to remove the waste container from the portable support for cleaning and rinsing.

The present invention provides for automatic cleaning of the waste container by toilet water without need for special plumbing to supply additional water to the cleaning station.

The present invention enables a portable commode to incorporate the advantages of known prior art commodes with the additional advantage of ease of cleaning provided by the present invention.

BRIEF DESCRIPTION OF THE DRAWINGS

All of the objects of the invention are more fully set forth hereinafter with reference to the accompanying drawings, wherein.

DESCRIPTION OF THE PREFERRED EMBODIMENTS

Figure 1:
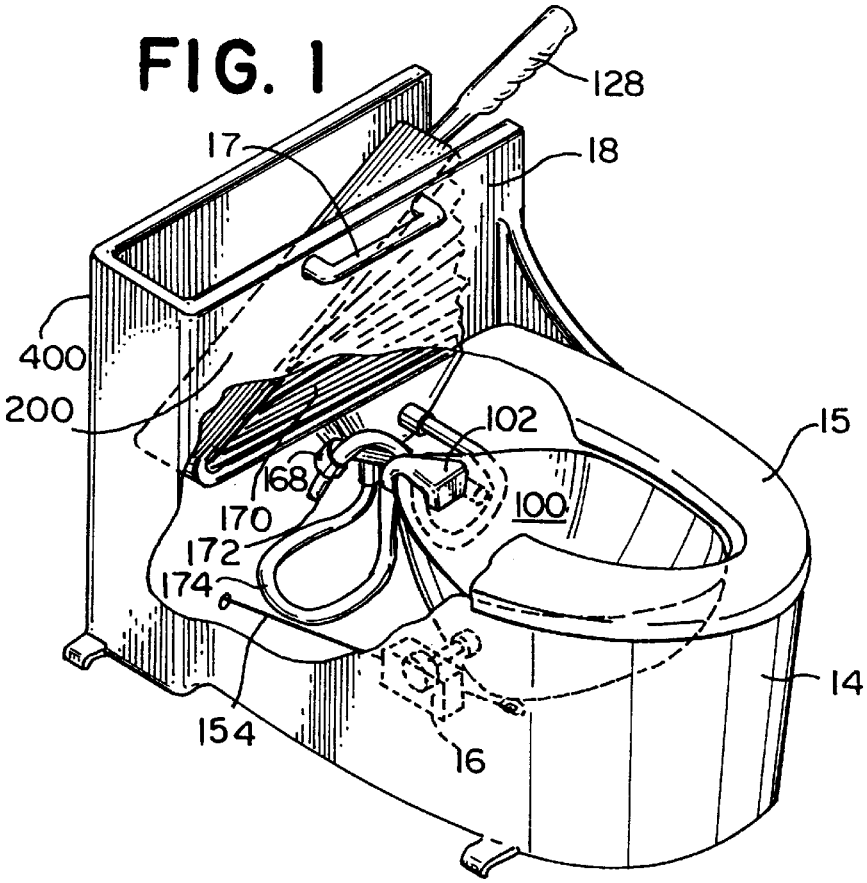
FIG. 1 is a perspective view of a portable commode embodying the present invention as seen from the front of the portable commode with portions broken away to shown interior parts.
Figure 2:
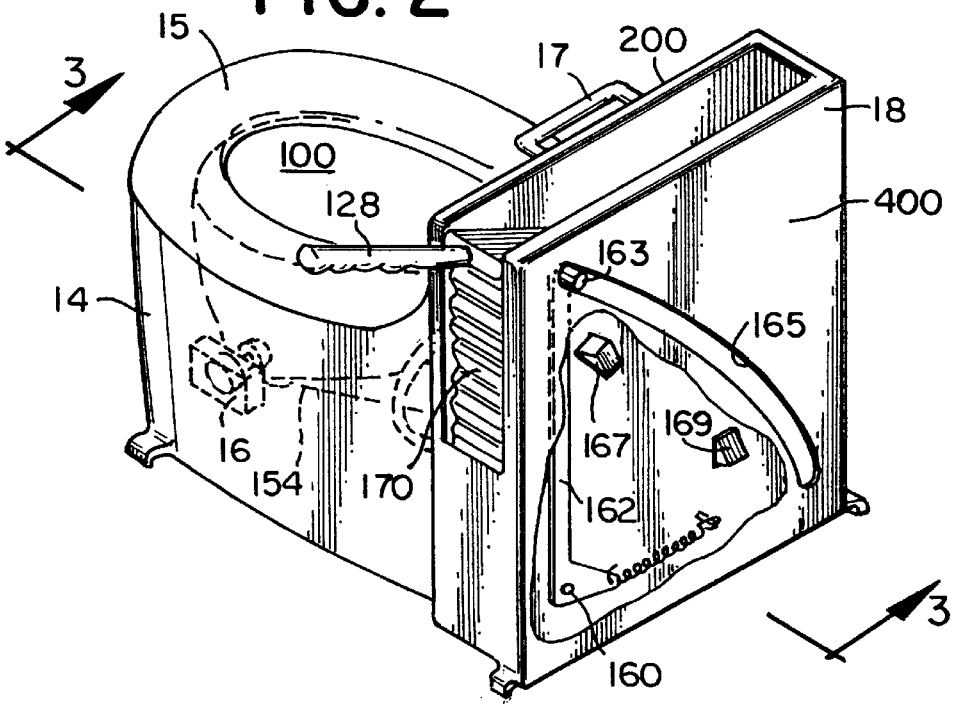
FIG. 2 is a rear perspective view of the portable commode shown in FIG. 1.
Figure 3:
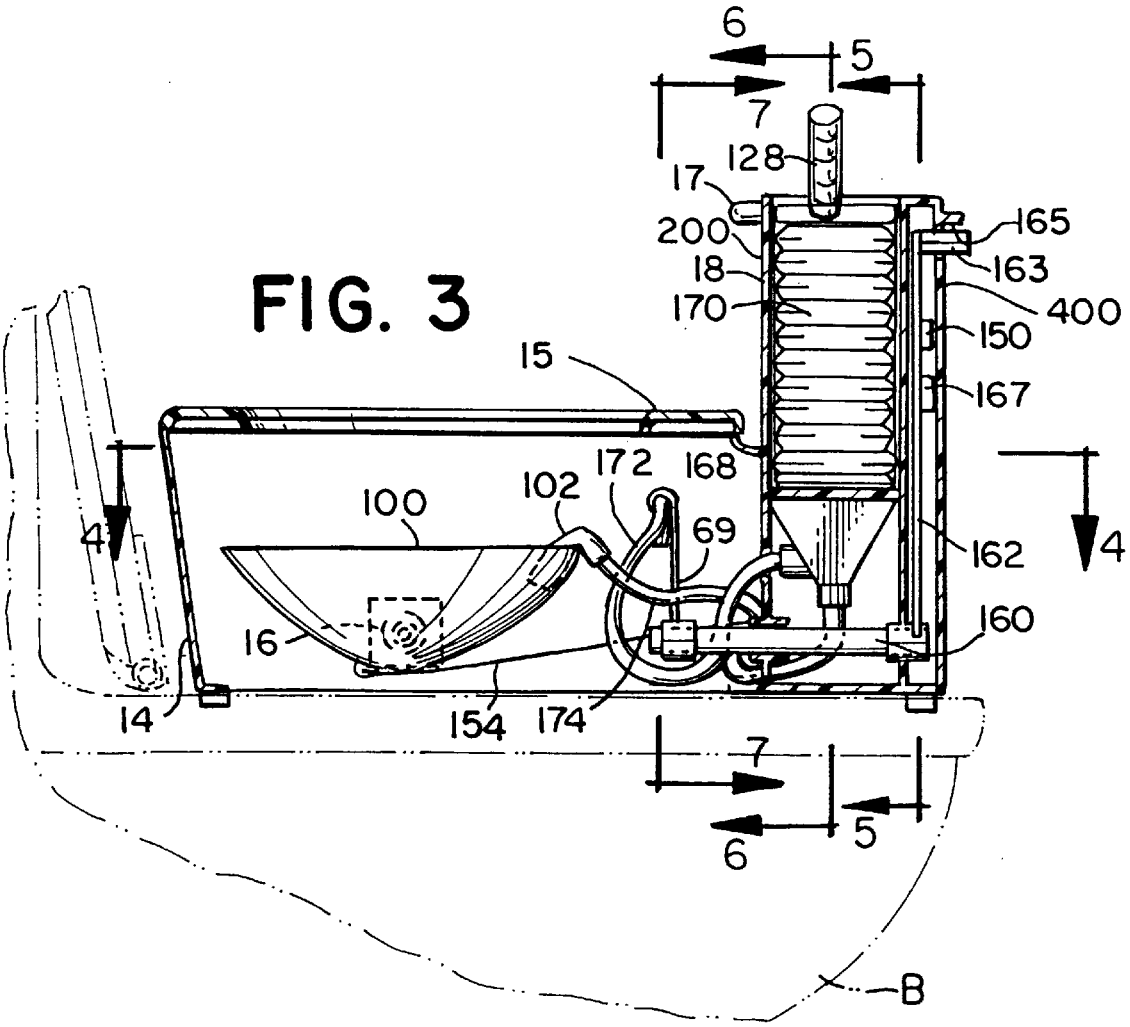
FIG. 3 is a sectional view taken on the line 3—3 showing the unit positioned on a fixed commode with its front facing the rear of the fixed commode (shown in broken lines)
Figure 4:
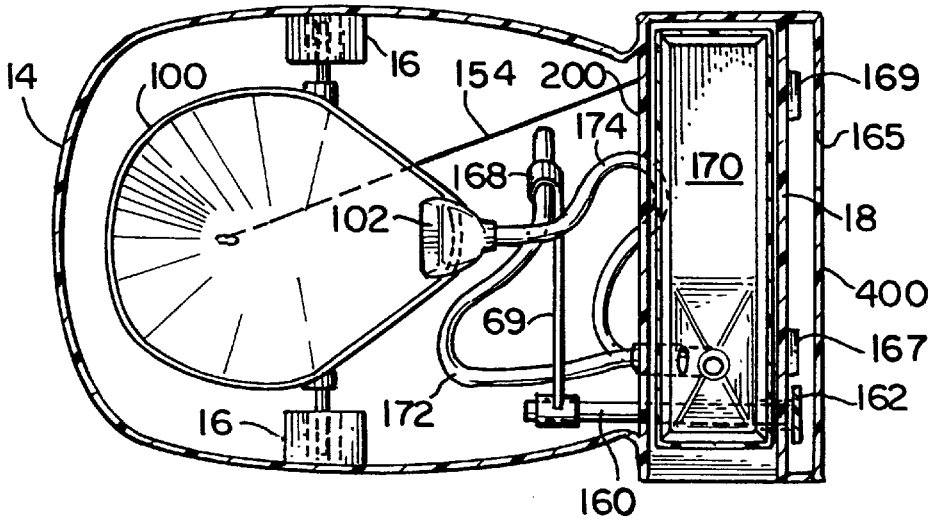
FIG. 4 is a horizontal sectional view taken on the line 4—4 of FIG. 3.
Figure 5:
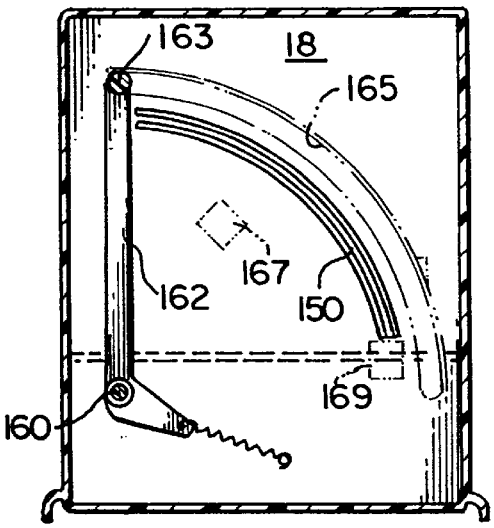
FIGS. 5, 6 and 7 are vertical sectional views taken on the lines 5—5, 6—6 and 7—7, respectively, of FIG. 3.
Figure 6:
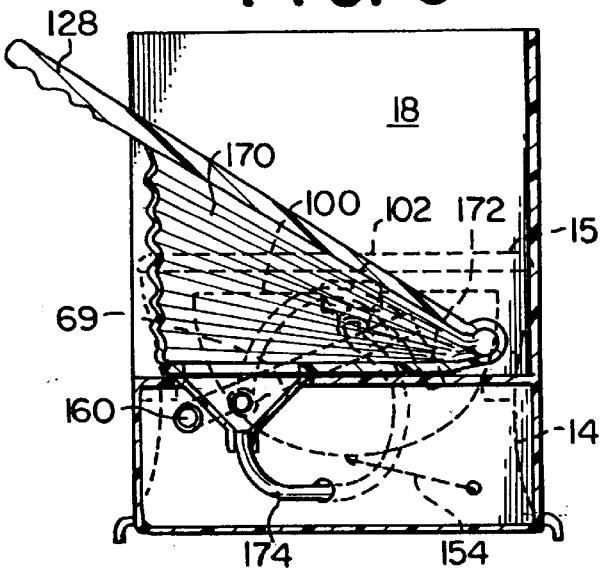
Figure 7:
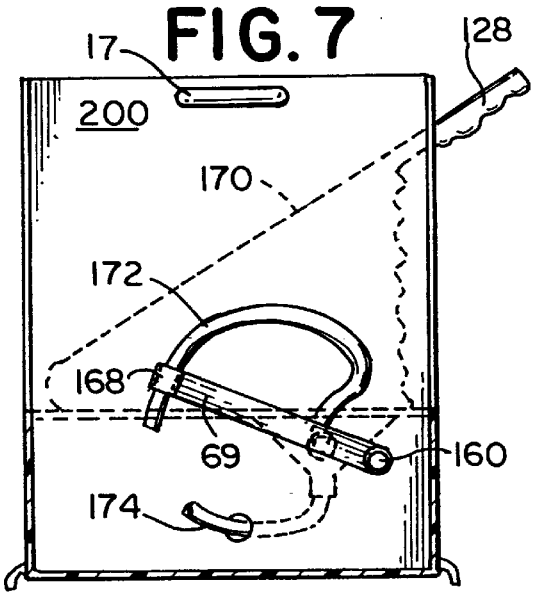

With reference to FIGS. 1, 2 and 3, a portable toilet embodying the present invention is illustrated, having a hollow support structure 14 with an upwardly-facing seat 15 for a human positioned on it. As shown in FIG. 1, the seat 15 is accessible from the front of the hollow support structure 14 so that when the support structure 14 is resting on the floor, the child may straddle the support structure 14 and sit on the seat 15. Behind the seat 15, there is a pump housing 18 having a handle 17 for carrying purposes and for stabilizing the portable toilet when it is resting on the fixed commode. As shown in FIGS. 3 and 4, the fixed commode is a regular household toilet whose bowl contains clean toilet water to receive waste for flushing into a sewer pipe or other drain, but the present invention may be used with any regular toilet having clean water for flushing. The bottom of the housing support structure 14 is open and is configured to be supported on a regular toilet, as shown in FIG. 3.

A bellows-type pump 170 having a pump operator handle 128 is positioned within the pump housing 18 which is defined between a front wall 200 and a rear wall 400. A spring-powered hose control lever 162 is pivoted to the rear wall 400 and has an operator 163 projecting through an arcuate slot 165 in the wall 400. Pivotal movement of the lever 162 by the operator 163 causes the lever to pivot to the lower position past a latch actuator 167 and to engage behind a latching device 169 adjacent the bottom of the slot. As shown in FIG. 3, the lever 162 has a pivot shaft 160 which is journaled in the walls 200 and 400 and has a hose arm 69 which extends radially from the shaft and has a hose holder 168 which engages the open end of an intake hose 172 of the pump 170. Preferably the intake end of the hose is a flexible conduit which incorporates a check valve to maintain the intake hose filled with toilet water, regardless of whether it is immersed in water or removed from water. When the lever 162 is in the upper position, the free end of the hose 172 is elevated into the interior of the housing 14. In the illustrated embodiment, when the lever is actuated to the bottom of the slot 165, the free end of the hose passes down through the bottom opening of the housing and dips into the fresh toilet water in the bowl B of the fixed commode shown in broken lines in FIG. 3. The lever has a spring bias tending to return the lever to the top of the arcuate slot, but is latched in the lower position against the bias by a suitable latch 169 coupled to the pump handle 128 by a connection not shown in the drawing.

With the hose 172 dipped into the water in the bowl B, the pump 170 is actuated by rotating the handle 128 on an axle to fill the bellows of the pump with water from the bowl B. Preferably, the pump handle 128 is lowered prior to or concurrently with the displacement of the lever 162 to evacuate the bellows so that the bellows may be filled with water from the bowl B by elevating the handle 128 to the position shown in FIG. 1. At that position, the bellows is filled with fresh toilet water from the bowl. The bellows of the pump 170 constitutes a pump chamber which enables retention of the water drawn through the hose 172. Upon completion of the upward stroke of the pump handle 128, the latch which holds the lever 162 in the lower position is released to allow the lever to return to its upright position and thereby raise the end of the inlet hose 172 out of the toilet water and into the interior of the housing 14. The check valve in the outlet end of the hose maintains the hose 172 filled as it is elevated.

Within the housing 14, a waste container 100 is positioned in its waste-receiving condition shown in full lines in FIG. 3. In the illustrated embodiment, the waste container 100 is journaled on pivots in the housing so that it may be rotated from the waste-receiving condition shown in FIG. 3 to a dumping condition shown in full lines in FIG. 10D. In its waste-dumping condition, the waste in the container is discharged directly into the toilet bowl B through the bottom opening of the hollow support structure 14.

Figure 10A:
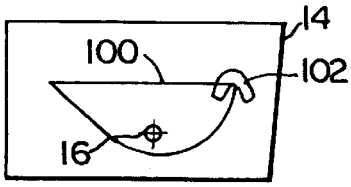
FIGS. 10A–10E are diagrammatic views showing the sequence of movement of the waste container.
Figure 8B:
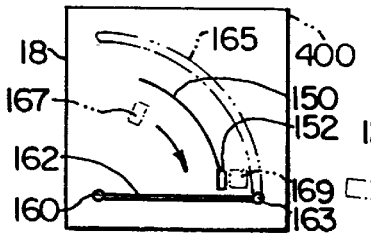
Figure 10B:
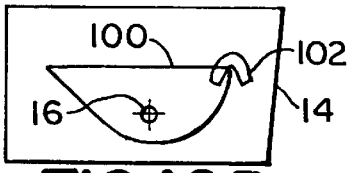
Figure 10C:
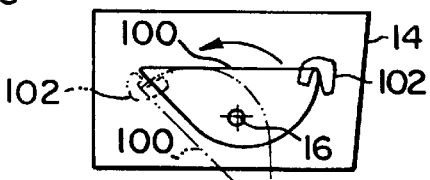
Figure 8D:
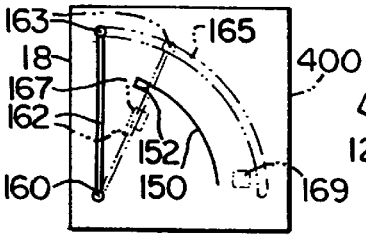
Figure 9D:
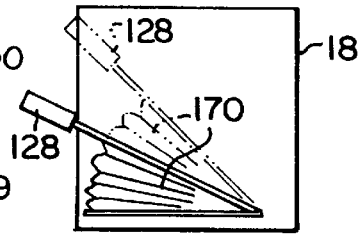
Figure 10D:
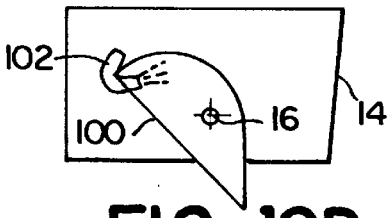
Figure 8E:
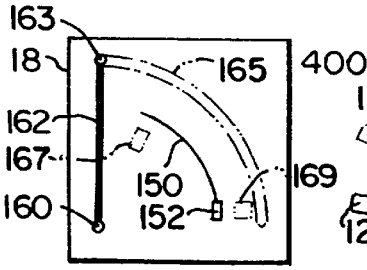
Figure 9E:
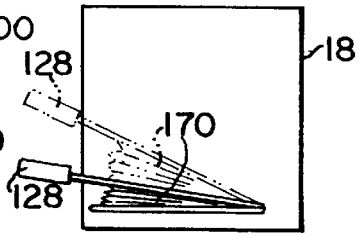

In the present instance, the container 100 is mounted in journals 16 for rotary movement between a horizontal rest position shown diagrammatically in FIG. 10A and an inverted dumping position shown in FIG. 10D. The container has a return spring (not shown) associated with the journals to bias the container to the rest position. The container 100 may be operated by a cable 154 attached to the bottom of the container 100 and extending through the pump housing 18. The end of the cable 154 is connected to a slider, shown diagrammatically at 152 in FIGS. 8A to 8E, which slides in an arcuate track 150 concentric with the arcuate slot 165. The container 100 is biased toward in its horizontal waste-receiving condition shown in full lines FIG. 3 so that when the slider is displaced to the top of its track 150, the container 100 is inverted against the bias of the spring-loaded journals to the dumping position shown in FIG. 10D by the cable 154. Suitable guides in the form of pulleys and conduits (not shown) permit freedom of movement of the cable to actuate the container 100 between its two positions. Displacement of the cable operates against the bias of the spring-loaded journals to afford tilting of the container 100 to dump its contents directly into the bowl B through the open bottom of the hollow structure 14. It is noted that the inside dimension of the bottom opening of the hollow housing 14 is larger than the outside dimensions of the container 100, and the container 100 is mounted in vertical registry with the open bottom of the housing 14, so that when the waste in the container is discharged by tilting the container, the waste passes through the open bottom directly into the bowl B without fouling the interior walls of the hollow housing 14.

Figure 8A:
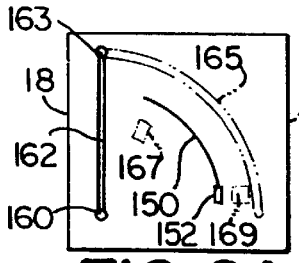
FIGS. 8A–8E are diagrammatic views illustrating the sequence of operation of the operating lever.
Figure 9A:
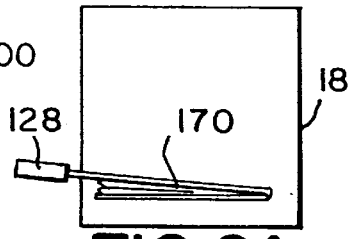
FIGS. 9A–9E are diagrammatic views showing the sequence of operation of the pump handle.

The operation of the device is diagrammed in FIGS. 8A–10E. After use of the portable toilet away from the regular toilet bowl, it is prepared for cleaning by placing the support 14 on the bowl B with its forward end facing the back of the fixed bowl. Preferably, the conventional toilet seat on the bowl is raised so that the hollow support 14 rests directly on the bowl as shown in broken lines in FIG. 3. The handle 17 is used to stabilize the portable toilet as the device is operated. At this point, the lever 162 is upright as shown in FIG. 8A; the pump handle 128 is down to collapse the bellows 170 as shown in FIG. 9A, and the container 100 is in its horizontal loading position shown in FIG. 10A. In the first operation, the lever 163 is displaced to the bottom of the arcuate slot 165 as diagrammed in FIG. 8B so as to displace the free end of the hose 172 into the toilet water in the bowl B. The lever 162 has a spring bias tending to return the lever to the vertical position so that the displacement of the handle from the position shown in FIG. 8A to the position shown in FIG. 8B is effected against the bias of the spring. The lever is latched in its lower position, for example by the latch mechanism 169. When latched, the lever 162 also interlocks the end of the lever 162 with a slider 152 which rides in a track 150 behind the slot 165 shown diagrammatically in FIGS. 8A–8E.

Figure 9B:
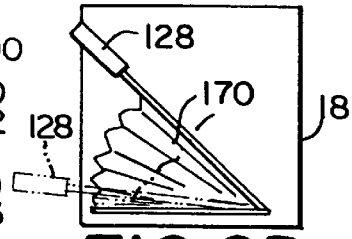
Figure 8C:
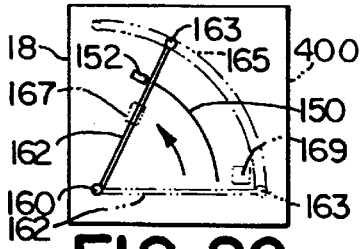
Figure 9C:
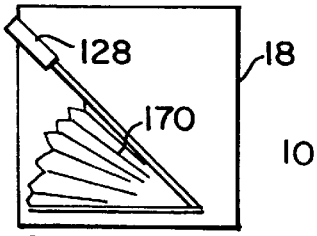

With the lever 162 latched in the lower position, the pump handle 128 may be raised as indicated in broken lines in FIG. 9B to expand the bellows chamber in the pump 170 and draw toilet water into the chamber through the hose 172 whose end is immersed in the bowl. At the top of its stroke, the pump 170 actuates the latch mechanism 169 to release the lever 162 and permit it to return to its upright position shown in FIG. 8C, under the spring bias of the lever. Upward movement of the lever 162 lets the hose arm 69 raise the hose end 172 out of the bowl B.

Since the lever is interlocked with the slider 152 at the end of the cable, the slider 152 is displaced to the upper end of its arcuate track 150 when the lever is moved to the top of its slot 165. The movement of the slider 152 extends the cable and tilts the container 100 as shown in FIG. 10C against the bias of the spring return mechanism in the journal 16. The displacement of the pump handle 128 operates the pump 170 to discharge the toilet water from the pump chamber through a check valve (not shown) in the outlet hose 174 and through the jets of a flushing outlet nozzle 102 at the rear of the container 100. The discharge of the toilet water through the hose 174 sprays the interior of the container to rinse any waste material which has not been dumped during the inversion of the container and discharges the rinse water along the rear wall of the container 100 and into the bowl.

Figure 10E:
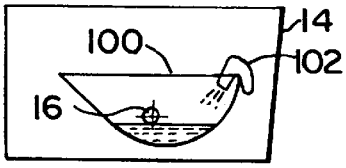

Before the pump chamber in the bellows pump is fully collapsed, for example when the chamber is 90% discharged, the downward movement of the handle 128 actuates the return mechanism for the container 100 so that the container is free to return to its horizontal position as shown in FIG. 10E under the action of the spring return mechanism in the journals 16. The pivotal return of the container 100 to the horizontal position extends the cable 154 to return its slide 152 to its normal position at the bottom of its track 150 where it is available to be engaged by the lever 162. Upon return of the container to its horizontal position, the final traverse of the pump handle to its bottom position discharges the toilet water remaining in the bellows compartment of the pump into the bottom of the container 100 to provide a residual amount of water to maintain the inside of the container sufficiently wet to avoid sticking of waste material to the bottom of the container during subsequent use. The portable potty may then be removed from the bowl B and the bowl may be flushed in the usual way.

If it is found that the container 100 required additional rinsing, the cycle may be repeated after flushing the bowl B.

The particular mechanisms described in connection with the illustrated embodiment are not critical to the operation of the invention and different mechanical movements and operating parts may be employed to achieved the desired results. For example the illustrated embodiment of the invention draws water from the same part of the regular toilet which later receives the waste discharged from the container. Where the design of the regular toilet permits, the water may be drawn from a different part of the regular toilet, or from a separate source of water.

I claim:

1. A method for using and cleaning a portable commode designed to receive human waste, said portable commode having a chamber for flushing water with an outlet, a housing with a configuration that fits over the bowl of an existing toilet structure, said existing structure having a waste-receiving bowl connected to a drain, a supply of toilet water and means to flush waste and said water from the bowl down the drain, said housing having an upwardly-facing annular toilet seat with a central opening, and a container underlying said central opening in said housing that operates between a waste receiving condition and a waste dumping condition, the said chamber outlet being directed toward the interior of the container, said portable commode being configured for use in association with said existing toilet, comprising the steps of:

using the said portable commode by supporting said housing at a place remote from said existing toilet, positioning a human body opening over said central opening and depositing human waste into the container when the container is in the waste receiving condition;

placing the said portable commode housing over the bowl of the existing toilet;

cleaning the said portable commode by operating the said container, with human waste in it, from the waste receiving condition to the waste dumping condition while the housing is placed over the bowl, dumping the waste into the bowl of the existing toilet; and discharging clean flushing water from said chamber through said outlet into and out of the said container to assist in the cleaning of the container.

2. A method for repeatedly using, and automatically cleaning a portable commode between uses, the portable commode having a housing with an upwardly-facing annular toilet seat with a central opening, and a container underlying said central opening in the housing movable between an operative waste receiving condition and a dumping condition, said portable commode housing having a chamber with a flushing outlet, said chamber adapted to receive fresh water and to discharge the fresh water through the outlet into the waste container, comprising the steps of:

using the portable commode at a place remote from an existing toilet structure by depositing waste through said central opening into the container when said container is in the waste receiving condition;

then cleaning the portable commode by moving the portable commode from said remote place to the existing toilet structure and placing the portable commode on top of the existing toilet structure and moving the container into the said dumping condition to dump waste therefrom into the existing toilet;

discharging fresh water from the said chamber through the said outlet and into and out of the said container while on top of the existing toilet structure;

returning said portable commode container to the waste-receiving condition in the housing and removing the portable commode from the existing toilet structure.

3. A method for cleaning a portable toilet over top of an existing toilet having a human waste-receiving bowl connected to a drain, a supply of toilet water, and a means to introduce the toilet water into the bowl to flush the same into said drain, said portable toilet having a housing with a configuration that fits over top of the bowl of the existing toilet, an annular toilet seat with a central opening, a container underlying said central opening that operates between a human waste receiving condition and a human waste dumping condition, and a chamber for flushing water, comprising the steps of:

using the portable toilet at a place remote from the existing toilet by depositing human waste through said central opening into the container while the container is in a waste receiving condition inside of said housing;

then cleaning the portable toilet by placing said portable toilet housing over the waste-receiving bowl of the existing toilet;

moving the container within the housing into a dumping condition to dump the waste into the bowl of the existing toilet while over the bowl;

discharging the said water from within the said chamber into the container while the container is over top of the bowl, said water flowing into and out of said container to assist the cleaning of the waste therefrom into the bowl;

returning the said container to the waste receiving condition after the water flows out of the container and removing the portable toilet from the bowl of the existing toilet; and reusing the portable toilet while said container is in a waste receiving condition.

4. A method for preparing a portable toilet for cleaning in association with an existing flush toilet having a waste-receiving bowl that connects to a drain, a supply of water, and means to introduce the water into the bowl, said portable toilet having a container, a housing with a bottom that fits over said existing toilet's waste-receiving bowl, and a water chamber with an outlet and an inlet which is movable relative to said housing, comprising the steps of:

placing the housing of the portable toilet over top of the toilet bowl of the existing toilet structure when the said portable toilet water chamber is empty, so that the bottom of the housing is at rest on the bowl;

lowering said portable toilet movable inlet from the portable toilet housing into water in the waste-receiving bowl;

introducing water from the waste-receiving bowl through the inlet and into the said chamber of the portable toilet; and retracting said movable inlet from water in the waste-receiving bowl while said housing is at rest.

5. A method according to claim 4 wherein said step of lowering said movable inlet is made while said housing is at rest on the toilet bowl, said inlet being moved relative to the portable toilet housing.

6. A method for cleaning a portable toilet into an existing commode having a waste-receiving bowl connected to a drain, a supply of water, and a means to introduce the water into the bowl to flush the same into the drain, said portable toilet having a hollow housing having an upwardly-facing annular seat with a central opening and having an open bottom that is configured to fit over top of the waste-receiving bowl, and a container in the housing between said seat and said open bottom that operates between a waste receiving condition and a waste dumping condition, comprising the steps of:

using the portable toilet away from the existing commode by supporting said housing at a place remote from said existing commode, and depositing human waste through said central opening into the container while the container is in a waste receiving condition inside of said housing;

then cleaning the container of said portable toilet by moving the portable toilet to said existing commode, and placing the open bottom of the portable toilet housing over the top of said waste-receiving bowl;

moving the container within the housing into a dumping condition to dump the waste into the waste-receiving bowl while over top of the said existing commode;

discharging the waste into the existing toilet bowl from within the said container through said open bottom while the container is in a dumping condition over top of the said waste-receiving bowl; and returning the said container to a waste receiving condition after the waste in the container is discharged and removing the portable toilet from the said existing commode.

7. A method according to claim 6 including the step of discharging clean water into said container while said container is in the waste receiving condition to avoid sticking of waste to the container.

8. A method according to claim 7 including the step of dumping the discharged water with the waste when discharging the waste into the existing toilet bowl.

9. A portable toilet for use in association with an existing toilet structure having a waste-receiving bowl connected to a drain, a supply of water, and a means to introduce the water into the bowl to flush the same into said drain, said portable toilet having a hollow support structure constructed and arranged to rest on a floor, said support structure forming a housing having an upwardly-facing annular seat with a central opening for a human and having an open bottom said bottom being configured to support the portable toilet when resting on the floor, and to fit over top of the toilet bowl when mounted on the existing toilet structure, and a container mounted in the housing between the central opening of said seat and said bottom for operation between a waste receiving condition and a waste dumping condition, in the waste-receiving condition, said container being positioned within the housing below said central opening and above the bottom to receive waste therein, when the bottom of the portable toilet housing is placed over the top of said toilet bowl, said hollow housing being configured to afford operation of the container within the housing into a dumping condition to dump the received waste directly into the toilet bowl of the existing toilet structure through said bottom and afford return of the said container to a waste receiving condition for re-use after the container is dumped.

10. A portable toilet according to claim 9, wherein said container has outside dimensions and said bottom has inside dimensions larger than said outside dimensions, said container being in vertical registry with said bottom.

11. A method for automatically cleaning a body waste container of a portable commode, said commode comprising a housing having an upwardly-facing annular toilet seat with a central opening, and supporting the waste container underlying said central opening for movement between an operative waste-receiving condition and a dumping condition, said commode having an outlet adapted to discharge cleaning water into the container, comprising the steps of:

placing the portable commode on top of a bowl of an existing commode with waste in the container received through the central opening, said existing commode having a supply of clean water contained therein for flushing the existing commode;

intaking said clean water from the existing commode into the portable commode;

operating the portable commode to move the waste container into the dumping condition to dump waste out of the container into said bowl; and discharging the intaken clean water through the outlet into and out of said container for cleaning the container and assisting dumping the waste into said bowl when the waste container is in the dumping condition.

12. A method for using a portable commode comprising a housing having an upwardly-facing annular toilet seat with a central opening, and a waste container underlying said central opening, cleaning the portable commode at an existing commode, and reusing the portable commode, said existing commode having a supply of clean water contained therein for flushing the existing commode, said portable commode waste container being supported for operation between an operative waste-receiving condition and a dumping condition, the portable commode having an outlet adapted to discharge clean water into the container, comprising the steps of:

placing the portable commode on a support at a place remote from the existing commode and depositing human waste in the container through the central opening;

placing the portable commode on top of a bowl of the existing commode;

intaking the clean water from the existing commode supply into the portable commode;

operating the waste container of the portable commode into the dumping condition to dump the human waste out of the container into the bowl;

discharging the intaken clean water through the outlet into and out of said container for cleaning the container and assisting dumping the the human waste into the bowl when the waste container is in the dumping condition; and moving said portable commode to a place remote from said existing commode and reusing the portable commode by depositing human waste through the central opening into the container when the container is in the operative waste-receiving condition.

* * * * *